US008359770B2

(12) United States Patent
Frederick

(10) Patent No.: US 8,359,770 B2
(45) **Date of Patent: *Jan. 29, 2013**

(54) DYNAMICALLY MODERATED SHOCK ATTENUATION SYSTEM FOR APPAREL

(75) Inventor: Edward Frederick, Brentwwod, NH (US)

(73) Assignee: Pierre Senizergues

( * ) Notice: Subject to any disclaimer, the term of this patent is extended or adjusted under 35 U.S.C. 154(b) by 1753 days.

This patent is subject to a terminal disclaimer.

(21) Appl. No.: 11/673,792

(22) Filed: Feb. 12, 2007

(65) Prior Publication Data

US 2013/0000020 A1 Jan. 3, 2013

(51) Int. Cl.
*A43B 13/12* (2006.01)

(52) U.S. Cl. ..... 36/28; 36/30 R; 36/44; 36/88

(58) Field of Classification Search ..... 36/28, 30 R, 36/44, 88, 93, 25 R; 428/424.4, 76; 2/455, 2/459, 463–467, 411, 22
See application file for complete search history.

(56) References Cited

U.S. PATENT DOCUMENTS

| | | | | |
|---|---|---|---|---|
| 4,183,156 | A | 1/1980 | Rudy | |
| 4,486,964 | A | 12/1984 | Rudy | |
| 4,506,460 | A | 3/1985 | Rudy | |
| 4,854,057 | A | 8/1989 | Misevich et al. | |
| 5,741,568 | A | 4/1998 | Rudy | |
| 5,854,143 | A | 12/1998 | Schuster et al. | |
| 6,701,529 | B1 | 3/2004 | Rhoades et al. | |
| 6,913,802 | B1 | 7/2005 | Plant | |
| 7,020,988 | B1 | 4/2006 | Holden et al. | |
| 7,788,826 | B2 * | 9/2010 | Frederick | 36/28 |

FOREIGN PATENT DOCUMENTS

GB 2349798 A 11/2000

OTHER PUBLICATIONS

Graham Budden, Defense and Comfort: New Advancement in Impact-Protection Textiles, T3 Technical Textile Technology, Apr. 2006, U.S.A.
Dow Corning Active Protection System Information Sheet.

* cited by examiner

*Primary Examiner* — Marie Patterson
(74) *Attorney, Agent, or Firm* — Stetina Brunda Garred & Brucker

(57) ABSTRACT

Various embodiments of this invention disclose a dynamically responsive shock attenuation system for apparel intended to protect boney areas of the body where skeletal structures are close to the surface and soft tissue layers are thin, that comprises two or more materials with different, narrowly prescribed physical properties which, when used together, produce a dynamic, continuous, and proportional response over a wide range of impact forces. In various embodiments of the invention, the two materials comprise a first material that exhibits generally Newtonian behavior to impact forces and a second material that exhibits generally non-Newtonian behavior to impact forces.

26 Claims, 2 Drawing Sheets

DYNAMICALLY MODERATED SHOCK ATTENUATION SYSTEM FOR APPAREL

RELATED PATENT APPLICATIONS

This patent application is related to the invention disclosed by the United States patent application for "Dynamically Moderated Shock Attenuation System for Footwear" by Edward C. Frederick, namely, U.S. patent application Ser. No. 11/673,777, filed on Feb. 12, 2007, which is incorporated herein by reference.

FIELD OF INVENTION

This invention relates, generally, to shock attenuation systems; more particularly, to shock attenuating systems for use in articles of apparel.

BACKGROUND

Shock attenuating systems in apparel have been used in innumerable applications for centuries in order to protect the body from a wide range of impacts. The classic problem for designers of apparel-related shock attenuating systems has been the development of cushioning systems that protect against a broad range of impacts while remaining comfortable and flexible enough to allow unencumbered movement of the body. This problem is illustrated by medieval plate armor, for example, which provides good protection from sharp impacts but minimal protection from blunt impacts. Moreover, medieval plate armor provides insufficient flexibility to allow the wearer to make quick, agile movements, and it is too uncomfortable to be worn for long periods of time.

Other types of shock attenuating systems for apparel that are used in sports experience similar shortcomings. Soccer shin-guards, for example, illustrate the shortcomings of an area-elastic system in providing shock attenuation to a broad range of impact forces. Soccer shin-guards typically comprise an outer layer made of a hard plastic material and an inner thin layer of foam or padded, compressible cushioning material. The soft cushioned layer mainly compensates for morphological variability on the surface of the shin area as these cushioning layers are too thin to provide significant shock attenuation. The outer stiff layer provides impact protection at low impact loads by acting like an area-elastic system and distributing the forces of impact over a broader area. However, when the shin-guard experiences a firm impact, the cushioning reaches its deformation capacity and no longer protects the wearer. Thus, the shin-guard is rendered inadequate because the cushioning layer bottoms out and the hard plastic layer firmly impacts the wearer's shin, creating regions of instantaneous high pressure where the hard plastic pushes against boney prominences.

Also, attire or padding worn in or under football uniforms experiences many of these same shortcomings. Under severe impacts, the pads that are worn to protect football players' bodies are compressed to their maximum capacity and no longer provide impact protection to the body. When stiffer pads are substituted for soft ones, they do not provide impact protection to less severe forces because the padded materials do not compress. Further, because cushions and pads operate, generally speaking as point-elastic systems, they do not provide significant protection from sharp, focused impacts. For example, while a soft football pad may soften the impact of a fall, it will do little to attenuate the impact of a strike from a sharply pointed object, such as an elbow.

Helmets that are worn in sports and in other applications to protect the wearer's head suffer from many of these shortcomings. Helmets typically feature a hard, outer shell and cushioned padding on the inside. The padding serves to attenuate relatively soft impacts while the shell protects against more harsh impacts. When the padding or cushioning reaches its displacement limit, however, it no longer serves to attenuate impact forces. Thus, forces that are sufficient to compress the padding are transmitted from the hard shell to the wearer's head.

Soft padded layers by themselves are therefore inadequate for protecting the body from high-pressure-producing impact from sharp objects. Hard and stiff layers are better at distributing the forces of sharp impacts but they are cumbersome and inhibit comfort and performance. In addition to being cumbersome, stiff shell-like padding systems have another common flaw.

This flaw in the design of most impact protection systems that attempt to use a hard outer layer to distribute forces is most apparent when they are tasked to protect anatomical regions where the layers of soft tissue are thin and do not offer much biological padding. These boney areas are the shin, elbow, knee, wrist, ankle, chin and other areas of the head. A sharp impact to one of these areas often is transmitted though the stiff outer layer directly applying high-pressure impact forces to the boney structures. The main reason for this is the variability in the morphology of the underlying boney structures.

The shapes of the boney regions over the knees, elbows, shins and so on vary from person to person and from left to right within the same person. These natural irregularities in individual morphology create high points in the individual's anatomy. Even if the hard shell of the padding is contoured to follow the approximate shape of the anatomy of the honey area, it can not follow the contours of each person's unique morphology. This means that, when high impact forces are transmitted via the shell to boney areas, high-pressure hot spots inevitably result. This is a major flaw of the hard shell approach.

Often a thin layer of foam will be added to compensate for these morphological irregularities, but as noted above, these thin layers of compressible material bottom out and the hot spot problem presents itself albeit at a slightly higher force level.

Designers of shock attenuating systems for attire are challenged to develop shock attenuating systems that adequately address the morphological irregularities over boney regions when both moderate impacts as well as more harsh impacts are experienced. On top of these requirements is the need to design padding for apparel that does not encumber the movements of athletes. Because of the shortcomings discussed above, there remains a long felt need in the art for a shock attenuating system whose resistance is dynamic over a wide range of impact forces. That is, a shock attenuating padding system that is flexible in the absence of impact forces and that provides impact protection to a broad range of impacts while adjusting to attenuate the effects of the impacts proportionally to the degree of the impact is highly desirable in the art.

Shock attenuating systems may be generally described in terms of point-elastic and area-elastic systems. A point-elastic shock attenuating system deforms non-uniformly (see FIG. 1). That is, for example, the greatest compliance is found under the area of highest pressure and the amount of deformation of the shock-attenuating layer varies in proportion to the distribution of forces over its surface. Standing on an inflated air mattress is an example of point-elastic behavior; the area just beneath the foot where pressures are high shows the greatest deformation while other areas show little or no deformation. Meanwhile, an area-elastic system distributes forces over a wider area causing a much greater area of the shock attenuating structure that is engaged in shock attenuating (see FIG. 2). A stiff sheet of plywood laid over an inflated air mattress is an example of an area-elastic system, because the forces applied by standing on the plywood are distributed over a much larger portion of area of the air mattress.

In order to implement and improve upon these conventional shock-attenuating systems, several systems have been developed using combinations of shock absorbing materials in order to provide shock absorption over a broader range of impact forces. U.S. Pat. No. 4,506,460 to Rudy, for example, discloses the use of a stiff moderator to distribute the forces of impact over a larger area of the shock attenuating system. The use of such moderators, however, further restricts the range of impact shocks that can be accommodated because the stiff moderator is limited in its shock absorbing abilities. While successfully distributing forces over a wider area, the stiff moderator fails to adequately absorb high impact forces. Another approach to providing shock attenuation is disclosed by U.S. Pat. No. 4,183,156 to Rudy. Rudy's '156 patent discloses an air cushion for shoe soles that uses a semi-rigid moderator in order to distribute the loads over the air cushion. While moderating the cushioning forces, this system suffers from some of the same shortcomings as that of the area-elastic systems discussed above. Also, the patent fails to disclose a method for providing dynamic moderation of the forces.

U.S. Pat. No. 4,486,964, also to Rudy, discloses another such spring moderator. The '964 patent discloses the use of a moderator having a high modulus of elasticity over a cushioning material. The '964 patent, however, fails to disclose the use of a non-Newtonian material as an improved, dynamic moderator. Another cushioning system, which utilizes a stiff layer of material sandwiched between two foam midsole layers, is disclosed by U.S. Pat. No. 4,854,057 to Misevich et al. Misevich's patent, however, fails to disclose a cushioning system that uses the advantageous features of both Newtonian and non-Newtonian materials.

Another such system is disclosed by U.S. Pat. No. 5,741,568 also to Rudy. Rudy's '568 patent discloses the use of a fluid filled bladder surrounded by an envelope, in order to combine the properties of compressible padding materials with the effects of fluid materials.

The use of non-Newtonian materials, particularly dilatant materials, has also been used in shock attenuating systems, in order to provide a broader range of impact force attenuation. A non-Newtonian material is a material, often a fluid or gel or gel-like solid, in which the stiffness of the material changes with the applied strain rate. Newtonian materials, meanwhile, are said to behave linearly in response to strain rate so their stiffness is constant over a wide range of strain rates.

Most materials used in shock attenuating systems are somewhat viscoelastic and are not perfectly Newtonian, but the degree to which they are sensitive to the rate of loading is negligible when compared with materials with their general, distinctly non-Newtonian properties.

"Newtonian materials," as we define them for the purposes of this invention, are compliant shock attenuating materials with predominately linear load displacement characteristics. Such Newtonian materials may demonstrate some non-linear properties in imitation of non-Newtonian properties, but they are essentially linear in their load displacement behavior. Furthermore, any distinctly non-Newtonian behavior of these materials can be explained by bottoming out, or, by extreme physical deformation of the material, and not by the fundamental physical and chemical properties that create the character of truly "non-Newtonian materials."

Materials that qualify for use as Newtonian in an effective cushioning system must be compliant enough to attenuate peak impact forces. Compliance in this context is the strain of an elastic body expressed as a function of the force producing that strain. Compliant shock attenuating systems are used to decelerate the mass that is producing peak impact forces. These compliant materials yield to the force of impact, but resist with proportional stiffness to decelerate the impacting mass in a controlled manner, thus reducing peak forces, and delaying the time to peak impact. Therefore, an effective Newtonian material is relatively linear in its load displacement properties, but also compliant enough and thick enough to significantly attenuate peak impact forces. A non-compliant material would not be able to attenuate peak forces. A material that was compliant, but too thin, would bottom-out and be inadequate as a shock attenuating material.

Non-Newtonian properties, meanwhile, are commonly described as either dilatant or pseudo-plastic. Dilatant materials demonstrate significant increases in stiffness as loading rate increases. Pseudo-plastic materials, on the other hand, show the opposite response to increased rates of loading, i.e., their stiffness decreases as loading increases.

U.S. Pat. Nos. 6,701,529, to Rhoades et al. and 5,854,143, to Shuster et al., disclose the use of dilatant materials to moderate the impact forces of a fall or of a ballistic collision. Neither of these patents, however, discloses the use of dilatant materials in combination with a layer of shock absorbing material for attenuating shocks over a broad range of impact forces. What is more, at higher rates of loading and higher force magnitudes, these dilatant materials by themselves would be relatively stiff and non-compliant. Using a dilatant material by itself means that higher impact modes induced in the described dilatant material and instantaneous increase in stiffness that make the material less shock attenuating. Accordingly, the dilatant material used by themselves may be less useful as a shock attenuating material. At the very instant that they need to provide the greatest amount of compliance and shock attenuation, they are less compliant and less shock attenuating.

When used over regions of the body with thick layers of soft tissue these systems may offer adequate protection. The soft tissues are compressible and compliant. Therefore a pad made of a dilatant material (U.S. Pat. Nos. 6,701,529 and 5,854,143) will stiffen when subjected to higher impact forces and distribute the load over a wider area of the underlying soft tissues. This means that the soft tissues are also being engaged in a way that takes advantage of their compliant shock attenuating properties.

The device shown and described in U.S. Pat. No. 6,913,802 appears to disclose a dilatant material that is used by itself to attenuate shocks. Foam appears to be attached to the dilatant material but does not appear to serve the purpose of shock attenuation. In support thereof, Col. 4, Lines 5-8 of the '802 Application describes the foam as increasing comfort for the wearer.

These same, systems would not, however, provide adequate impact protection over boney areas of the body. Thus, the use of these materials would be undesirable in applications where attenuation of high impact forces is required to protect the body's many boney regions such as knees, elbows, hips and so on.

Another approach to using a combination of materials for shock attenuation is disclosed by U.S. Pat. No. 7,020,988 to Holden et al. Holden's invention discloses a shock attenuating system wherein a system used to attenuate the lower range of impacts is used in combination with a non-compressible second system that is engaged and allowed to provide shock attenuation for the higher range of impacts. Thus, this system allows for both extreme and ordinary impacts to be attenuated if included in an article of apparel. This combined system, however, remains limited by the narrow physical properties of the two individual systems that have been selected for use. Also, the response of the combined system is limited because the two-component system is somewhat discontinuous in its shock attenuating properties.

Thus, there remains a long felt need in the art for a shock attenuating system for apparel that can be used to protect boney regions of the body, and that is responsive to a broad range of impact force magnitudes, that provides attenuation fairly continuously over a wide range of forces, and that responds to these forces proportionally and adjusts automatically to the actual impact load that it is called upon to absorb.

BRIEF DESCRIPTION OF THE DRAWINGS

These and other features and advantages of the various embodiments disclosed herein will be better understood with respect to the following description and drawings, in which like numbers refer to like parts throughout, and in which.

DETAILED DESCRIPTION OF THE INVENTION

Figure 1:
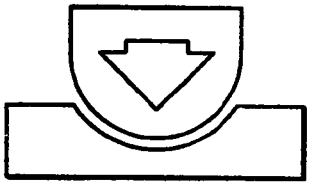
FIG. 1 (PRIOR ART)
FIG. 1 is an illustration of a prior art point elastic system.
Figure 2:
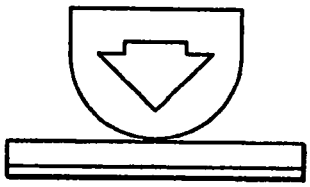
FIG. 2 (PRIOR ART)
FIG. 2 is an illustration of a prior art area elastic system.

In the following detailed description of various embodiments of the invention, numerous specific details are set forth in order to provide a thorough understanding of various aspects of one or more embodiments of the invention. However, one or more embodiments of the invention may be practiced without these specific details. In other instances, well-known methods, procedures, and/or components have not been described in detail so as not to unnecessarily obscure aspects of embodiments of the invention.

While multiple embodiments are disclosed, still other embodiments of the present invention will become apparent to those skilled in the art from the following detailed description, which shows and describes illustrative embodiments of the invention. As will be realized, the invention is capable of modifications in various obvious aspects, all without departing from the spirit and scope of the present invention. Accordingly, the detailed description is to be regarded as illustrative in nature and not restrictive. Also, although not explicitly recited, one or more embodiments of the invention may be practiced in combination or conjunction with one another. Furthermore, the reference or non-reference to a particular embodiment of the invention shall not be interpreted to limit the scope the invention.

In the following description, certain terminology is used to describe certain features of one or more embodiments of the invention. For instance, "apparel" refers to any of the various coverings and protectors for the human body including: shirts, undershirts, pants, underpants, hats, helmets, face guards, shin-guards, athletic supporters, groin protectors, gloves, hand pads, head guards, mittens, jerseys, shorts, deflectors, chest guards, throat protectors, spine protectors, knee-guards, boots, footwear, ankle protectors, shin guards, kidney belts, martial arts pads, leg pads, That pads, sparring pads, boxing gloves, boxing coaching pads, handlebar pads, hook and jab pads, football girders, rib pads, forearm pads, elbow guards, shoulder braces, harness pads, race guards, bicycle or motorcycle seats, chest protectors, back packs, hip pads, shoulder straps, wrist stabilizers, wrist pads, and other such items; "shock attenuating systems for attire" refers to any of the various devices used to dampen shocks or to prevent excessive pressure such as padding, cushioning, shock absorbing materials, pads, pillows, mufflers, or other such materials that are used integrally or removably with any of the above forms of attire.

Various embodiments of the invention are directed towards improving upon the above shortcomings by disclosing a dynamically responsive shock attenuation system for apparel that automatically changes its mechanical properties in response to the level of force applied and the rate of loading of that impact force. One embodiment of the invention achieves these goals by utilizing a combination of two materials with different, narrowly prescribed physical properties that, when used together, produce a continuous and proportional response over a wide range of impact forces.

Figure 3:
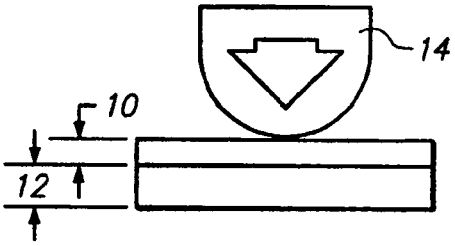
FIG. 3 is an illustration of a non-Newtonian material in combination with a Newtonian material.
Figure 4:
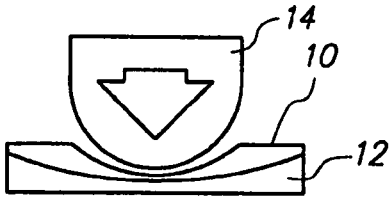
FIG. 4 is an illustration of the non-Newtonian material and Newtonian material in FIG. 3 with a light impact load.
Figure 5:
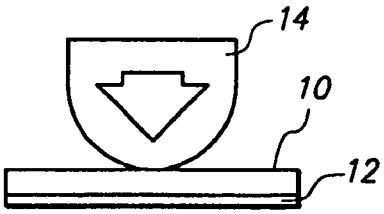
FIG. 5 is an illustration of the non-Newtonian material and Newtonian material in FIG. 3 with a high impact load.

In various embodiments of the invention, a proportional response is achieved by using a non-Newtonian material 10 in combination with a generally Newtonian material 12 (see FIG. 3) to produce a predictable varying moderating effect that causes the shock attenuating system to range between point-elastic and area-elastic in its physical properties, as shown in FIGS. 4 and 5.

The use of point-elastic shock attenuating systems in shock attenuating systems for attire provides comfortable shock attenuation at relatively low impact forces. With higher impact forces, the narrow column of point-elastic shock attenuating material underlying the higher-pressure areas will reach its displacement limit or bottom out and will no longer provide adequate shock attenuation.

The use of a moderator, functioning similarly to the stiff sheet of plywood mentioned in the example above, distributes the impact forces over the whole area of the shock attenuating material, which underlies the moderator. This creates an area-elastic system that is able to absorb higher impact forces because it can engage a much larger area and distribute the force over this larger area.

Nonetheless, the introduction of a stiff moderator, such as that disclosed by Rudy's '460 patent, above, introduces other undesirable limitations. For example, area-elastic systems are not as anatomically conformable as point-elastic systems, and area-elastic systems may be biomechanically unstable. More importantly for sports applications that require a wide range of impact attenuation, area-elastic systems have a limited range of effectiveness as shock attenuating systems. Thus, while an area-elastic system is capable of absorbing relatively higher impact forces, it may be considered too stiff and ineffective to absorb lower magnitude impact forces and, therefore, may be too uncomfortable for the wearer.

Various embodiments of the invention improve upon these shortcomings by using non-Newtonian materials 10. By way of example and not limitation, by combining this dynamically responsive NNM 10 with a layer of compliant shock attenuating materials 12, a shock attenuation system is created that behaves in a point-elastic manner under low level impacts (see FIG. 4) and in an area-elastic manner under high level impacts (see FIG. 5).

Meanwhile, at intermediate impact levels, the system will mix point-elastic and area-elastic properties in proportion to the load and rate of loading, such that a relatively continuous shock attenuation range is created. That is, the system will adapt automatically to vary its shock attenuation properties in response to the level of impact forces. Thus, at intermediate levels, the invention allows for a gradual transition between point-elastic and area-elastic properties.

The cushioning layer 12 used in combination with the NNM 10 generally behaves in a Newtonian or linear manner in response to impact forces in order to best take advantage of the effects of the dynamically adjusting NNM layer.

In various other embodiments of the invention, a shear thickening or dilatant material may be utilized within the moderator 10 to increase stiffness in proportion to the load in order to create a progressively increasing shock attenuation system progressively increasing in stiffness. In yet other embodiments of the invention, a thixotropic material may be used in the moderator to produce a progressively decreased stiffness in response to high loads. Thixotropic materials generally exhibit time-dependent change in resistance such that the longer the materials undergoes shear, the lower their resistance.

Figure 6:
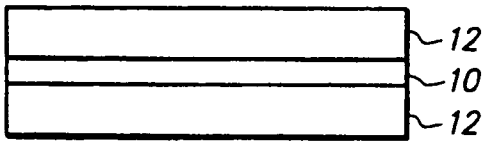
FIG. 6 is one embodiment of various moderators used in combination or tandem with one another to produce effects specific to the forces encountered on various parts of the foot under pressure.
Figure 7:
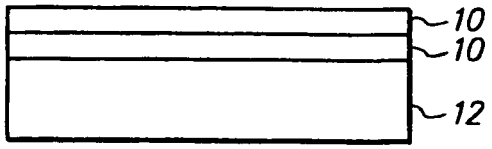
FIG. 7 is an alternative embodiment to the embodiment shown in FIG. 6.

These various moderators may be used in combination or tandem with one another to produce effects specific to the forces encountered on various parts of the body under pressure (e.g., see FIGS. 6 and 7). Naturally, the various materials may be tailored to the impacts encountered in the specific sports or industrial application for which the shock attenuating system is utilized.

One class of dilatant materials that may be used to produce the NNM is polyborosiloxanes. Other materials that are useful in the construction of the NNM and remain within the contemplation of this invention include, but are not limited to: rheopectic materials, thixotropic materials, pseudo-plastics, Bingham plastic materials, anelastic materials, yield pseudo-plastic, yield dilatant materials, and Kelvin materials. These and other materials may be adapted to the NNM to create biomechanically defined shock attenuation properties.

Some materials known in the art for constructing the Newtonian cushioning layer and that remain within the contemplation of the invention include, without limitation: inflated or gas-filled bladders, slabs of Ethylene Vinyl Acetate foam, Polyurethane and other conventional foam materials, gel or gel-like materials, structural plastic point-elastic cushioning systems, and other materials, known within the art, which provide a compliant shock attenuating layer that can function as an area-elastic or a point-elastic shock attenuating system when appropriately moderated by the NNM.

Figure 8:
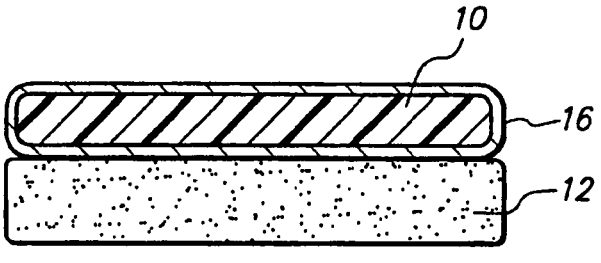
FIG. 8 is an illustration of an encapsulated non-Newtonian material which is used in combination with a Newtonian material.

In various embodiments of the invention, the NNM is encapsulated or otherwise contained such that its lateral expansion is limited, as shown in FIG. 8. An encapsulating material 16, generally speaking, should have a high degree of elasticity and resilience such that it does not interfere with or mask the physical properties of the non-Newtonian material 10. Some encapsulating materials that are known within the art and are within the contemplation of the invention include, without limitation: encapsulating film envelopes; sheets of plastic film or plastic film envelopes; polyurethane film envelopes; envelopes or coatings made from resilient butyl rubber, nitrile rubber, latex, or other elastomers; polymer based envelopes; woven fabric envelopes, various coatings created by dipping or spraying; and other such materials known within the art.

Figure 9:
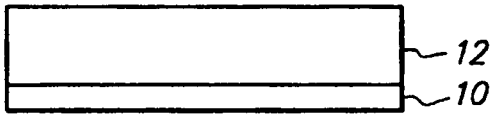
FIG. 9 is an illustration of a Newtonian material disposed above a non-Newtonian material.
Figure 10:
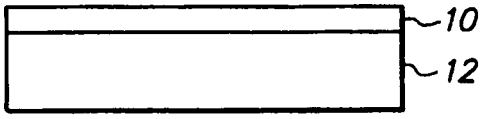
FIG. 10 is an illustration of a non-Newtonian material disposed over a Newtonian material.

It should be noted that the various embodiments of the invention are claimed without any specific claim to an orientation or configuration because the principles of the invention may be practiced in a number of orientations and configurations. For example, a Newtonian material 12 may be placed over a non-Newtonian material 10 (see FIG. 9), or visa-versa (see FIG. 10). Also, a non-Newtonian section may be included over a portion of a Newtonian pad. These and other variations are known within the art and these various orientations and configurations remain within the contemplation of the invention.

It should further be noted that the principals of the invention may be practiced with any of the various shock attenuating mechanisms for attire known in the art. The principals of the invention may, for example, be practiced with chest or shin guards that use integrated padding. The principals of the invention may also be used with padded that is removable from the apparel, such as the padding used in football girdles. Also, the principals of the invention may be practiced with freestanding shock attenuating articles such as handlebar padding or boxing coaching pads that are not directly attached to the body but are intended to interact with boney areas of the body when in use.

In yet other applications, the principals of the invention may be applied to cushioning systems in helmets and other head protectors. Furthermore, the principles of the invention may be applied to shoulder straps in baggage, such as backpacks, in order to reduce the strain on the shoulder bones from heavy loads. Skiing and snowboarding equipment, such as boots and protectors, may also benefit from the application of various principals of the invention to the padding used within the boots and protectors. The dynamically moderated shock attenuating system may be used in these and several other apparel applications to provide protection to the wearer's body.

In an aspect of the invention, a shock attenuation system for apparel is provided. The system may comprise a multi-layered system comprising a first layer and a second layer. The first layer may comprise a moderating material that generally exhibits non-Newtonian behavior in response to impact force. The second layer may comprise a cushioning material that generally exhibits Newtonian behavior in response to impact force. The shock attenuation system for apparel may additionally comprise a plurality of shock attenuation units. The shock attenuation units may each be composed of the multi-layered system comprising a first layer and a second layer. Additionally or alternatively, in the shock attenuation system for apparel, the number of first layers comprising moderating materials that generally exhibit non-Newtonian behavior in response to impact forces and the number of second layers comprising cushioning materials that generally exhibit Newtonian behavior in response to impact forces may be related by a ratio of one-to-one.

In summary, various embodiments of the invention comprise a shock attenuating system that is a combination of a compliant, Newtonian material and a non-Newtonian moderator that combine to produce a system that is responsive to a broad range of impact force magnitudes, provides attenuation fairly continuously over the range of forces, and responds to these forces proportionally to the actual impact load that it is absorbing.

What is claimed is:

1. A shock attenuation system for apparel, comprising:

a multi-layered system comprising a first layer and a second layer;

said first layer comprising a moderating material that generally exhibits non-Newtonian behavior in response to impact force, said first layer being generally contoured to a body part of a wearer; and said second layer comprising a cushioning material that generally exhibits Newtonian behavior in response to impact force.

2. A shock attenuation system for apparel according to claim 1, wherein said moderating material is selected from a group consisting of: plastic materials, Bingham plastic materials, yield pseudo-plastic materials, yield dilatant materials, polyborosiloxanes, "shear thinning" materials, "shear thickening" materials, Maxwell materials, Oldroyd-B materials, Kelvin materials, Anelastic materials, Rheopectic materials, thixotropic materials, and combinations thereof.

3. A shock attenuation system for apparel according to claim 1, wherein said cushioning material is selected from a group consisting of: gas filled bladders, Ethylene-Vinyl Acetate, Polyurethane, foam materials, gel or gel-like materials, structural point-elastic cushioning systems, polymer based cushioning materials, and combinations thereof.

4. A shock attenuation system for apparel, comprising:

a multi-layered system comprising a first layer and a second layer;

said first layer comprising a moderating material that generally exhibits non-Newtonian behavior in response to an impact force;

said second layer comprising a cushioning material that generally exhibits Newtonian behavior in response to the impact force; and an encapsulating envelope surrounding said second layer, said encapsulating envelope limiting lateral expansion of said second layer in response to impact force.

5. A shock attenuation system for apparel according to claim 4, wherein said encapsulating envelope is selected from a group consisting of: encapsulating film envelopes, plastic film envelopes, polyurethane film envelopes, polymer-based envelopes, fabric envelopes, elastomeric coatings or films, and combinations thereof.

6. A shock attenuation system for apparel, comprising:

a first cushioning region and a separate second cushioning region;

said first cushioning region and said second cushioning region each comprising a multi-layered system with a first layer and a second layer;

said first layer of said first region comprising a first moderating material that generally exhibits non-Newtonian behavior in response to impact force;

said second layer of said first region comprising a first cushioning material that generally exhibits Newtonian behavior in response to impact force;

said first layer of said second region comprising a second moderating material that generally exhibits non-Newtonian behavior in response to impact force; and said second layer of said second region comprising a second cushioning material that generally exhibits Newtonian behavior in response to impact force.

7. A shock attenuation system for apparel according to claim 6, wherein said first and second moderating materials are selected from a group consisting of: plastic materials, Bingham plastic materials, yield pseudo-plastic materials, yield dilatant materials, polyborosiloxanes, "shear thinning" materials, "shear thickening" materials, Maxwell materials, Oldroyd-B materials, Kelvin materials, Anelastic materials, Rheopectic materials, thixotropic materials, and combinations thereof.

8. A shock attenuation system for apparel according to claim 6, wherein said first and second cushioning materials are selected from a group consisting of: gas filled bladders, Ethylene-Vinyl Acetate, Polyurethane, foam materials, gel or gel-like materials, structural point-elastic cushioning systems, polymer based cushioning materials, and combinations thereof.

9. A shock attenuation system for apparel according to claim 6, wherein said shock attenuating system for apparel further comprises an encapsulating envelope surrounding said second layer, said encapsulating envelope limiting expansion of said second layer in response to the impact force and said encapsulating envelope being selected from a group consisting of: encapsulating film envelopes, plastic film envelopes, polyurethane film envelopes, polymer-based envelopes, woven fabric envelopes, elastomeric coating, films, and combinations thereof.

10. A shock attenuation system for apparel according to claim 1, wherein said shock attenuation system for apparel comprises a plurality of shock attenuation units, said shock attenuation units each composed of said multi-layered system comprising a first layer and a second layer.

11. A shock attenuation system for apparel according to claim 10, wherein the number of said first layers comprising moderating materials that generally exhibit non-Newtonian behavior in response to impact forces and the number of said second layers comprising cushioning materials that generally exhibit Newtonian behavior in response to impact forces are related by a ratio of one-to-one.

12. A shock attenuation system for apparel according to claim 1, wherein said shock attenuation system for apparel is integrally connected to the apparel.

13. A shock attenuation system for apparel according to claim 1, wherein said shock attenuation system for apparel is removably connected to the apparel.

14. A shock attenuation system for apparel according to claim 1, wherein said shock attenuation system for apparel comprises a stand-alone article of apparel.

15. A shock attenuation system for apparel according to claim 4, wherein said shock attenuation system for apparel is integrally connected to the apparel.

16. A shock attenuation system for apparel according to claim 4, wherein said shock attenuation system for apparel is removably connected to the apparel.

17. A shock attenuation system for apparel according to claim 4, wherein said shock attenuation system for apparel comprises a stand-alone article of apparel.

18. A shock attenuation system for apparel according to claim 6, wherein said shock attenuation system for apparel is integrally connected to the apparel.

19. A shock attenuation system for apparel according to claim 6, wherein said shock attenuation system for apparel is removably connected to the apparel.

20. A shock attenuation system for apparel according to claim 6, wherein said shock attenuation system for apparel comprises a stand-alone article of apparel.

21. A shock attenuation system for apparel according to claim 1, wherein said shock attenuation system for apparel comprises a type of apparel selected from a group consisting of: shirts, undershirts, pants, underpants, hats, helmets, face guards, shin-guards, athletic supporters, groin protectors, gloves, hand pads, head guards, mittens, jerseys, shorts, deflectors, chest guards, throat protectors, spine protectors, knee-guards, boots, footwear, ankle protectors, shin guards, kidney belts, martial arts pads, leg pads, Thai pads, sparring pads, boxing gloves, boxing coaching pads, handlebar pads, hook and jab pads, football girders, rib pads, forearm pads, elbow guards, shoulder braces, harness pads, race guards, bicycle or motorcycle seats, chest protectors, back packs, hip pads, shoulder straps, wrist stabilizers, and wrist pads.

22. A shock attenuation system for apparel according to claim 4, wherein said shock attenuation system for apparel comprises a type of apparel selected from a group consisting of: shirts, undershirts, pants, underpants, hats, helmets, face guards, shin-guards, athletic supporters, groin protectors, gloves, hand pads, head guards, mittens, jerseys, shorts, deflectors, chest guards, throat protectors, spine protectors, knee-guards, boots, footwear, ankle protectors, shin guards, kidney belts, martial arts pads, leg pads, Thai pads, sparring pads, boxing gloves, boxing coaching pads, handlebar pads, hook and jab pads, football girders, rib pads, forearm pads, elbow guards, shoulder braces, harness pads, race guards, bicycle or motorcycle seats, chest protectors, back packs, hip pads, shoulder straps, wrist stabilizers, and wrist pads.

23. A shock attenuation system for apparel according to claim 6, wherein said shock attenuation system for apparel comprises a type of apparel selected from a group consisting of: shirts, undershirts, pants, underpants, hats, helmets, face guards, shin-guards, athletic supporters, groin protectors, gloves, hand pads, head guards, mittens, jerseys, shorts, deflectors, chest guards, throat protectors, spine protectors, knee-guards, boots, footwear, ankle protectors, shin guards, kidney belts, martial arts pads, leg pads, Thai pads, sparring pads, boxing gloves, boxing coaching pads, handlebar pads, hook and jab pads, football girders, rib pads, forearm pads, elbow guards, shoulder braces, harness pads, race guards, bicycle or motorcycle seats, chest protectors, back packs, hip pads, shoulder straps, wrist stabilizers, and wrist pads.

24. A shock attenuation system for apparel according to claim 1, wherein the first layer is disposed above the second layer.

25. A shock attenuation system for apparel according to claim 6, wherein the first layers of the first and second cushioning regions are disposed over the second layers of the first and second cushioning regions.

26. A shock attenuation system for apparel according to claim 6, wherein the first moderating material is a shear thickening material and the second moderating material is a thixotropic material.

* * * * *